US009689168B1

(12) United States Patent
Corness et al.

(10) Patent No.: US 9,689,168 B1
(45) Date of Patent: Jun. 27, 2017

(54) FLOOR-TRANSITION SETTING SYSTEMS

(71) Applicants: Ryan Shawn Corness, Langley (CA); Roger James Grafstrom, Abbotsford (CA)

(72) Inventors: Ryan Shawn Corness, Langley (CA); Roger James Grafstrom, Abbotsford (CA)

( * ) Notice: Subject to any disclaimer, the term of this patent is extended or adjusted under 35 U.S.C. 154(b) by 0 days.

(21) Appl. No.: 15/222,833

(22) Filed: Jul. 28, 2016

(51) Int. Cl.

| | |
|---|---|
| ***E04F 21/00*** | (2006.01) |
| ***E04F 21/18*** | (2006.01) |
| ***E04F 21/22*** | (2006.01) |
| ***E04F 15/02*** | (2006.01) |
| ***E04F 19/04*** | (2006.01) |
| ***E04F 19/06*** | (2006.01) |
| ***E04F 13/08*** | (2006.01) |
| ***E04F 11/02*** | (2006.01) |

(52) U.S. Cl.
CPC ..... *E04F 21/22* (2013.01); *E04F 11/02* (2013.01); *E04F 13/0885* (2013.01); *E04F 15/0215* (2013.01); *E04F 19/04* (2013.01); *E04F 19/0459* (2013.01); *E04F 19/061* (2013.01); *E04F 21/18* (2013.01)

(58) Field of Classification Search
None
See application file for complete search history.

(56) References Cited

U.S. PATENT DOCUMENTS

| | | | | |
|---|---|---|---|---|
| 418,938 | A * | 1/1890 | Rogusch | E04G 1/32 108/115 |
| 3,183,598 | A * | 5/1965 | Charles | B28D 1/225 33/464 |
| 3,643,992 | A | 2/1972 | Jacobucci | |
| 4,091,945 | A | 5/1978 | Patterson | |
| 5,617,962 | A * | 4/1997 | Chen | A47G 25/0664 211/204 |
| 5,642,975 | A * | 7/1997 | Epstein | B65G 49/061 414/11 |
| 5,680,732 | A * | 10/1997 | Skouras | E04G 25/04 52/114 |
| 5,862,644 | A | 1/1999 | Jones | |
| 5,867,965 | A | 2/1999 | Pitz et al. | |
| 5,924,660 | A * | 7/1999 | Marron | B25B 1/2484 248/163.1 |
| 6,047,520 | A | 4/2000 | Caraballo | |

(Continued)

FOREIGN PATENT DOCUMENTS

CA 2790556 3/2013

*Primary Examiner* — Joshua J Michener
*Assistant Examiner* — Kyle Walraed-Sullivan
(74) *Attorney, Agent, or Firm* — Integrity Patent Group, PLC; Edwin Wold

(57) ABSTRACT

A modular system for setting flooring transitions with adequate pressure during setup and curing of adhesive. The floor-transition-setting system includes a plurality of members such as a connector-body, a plurality of extension-bodies, a plurality of leg-members, and a plurality of pressure-feet. The connector-tubular-body being in functional and adjustable combination with each of the plurality of female-push-button-couplers. Each of the plurality of extension-bodies has a male-push-button-adjuster-coupler and an extension-tubular-body. The system may include one or more assemblies and may be configured without the use of tools.

20 Claims, 5 Drawing Sheets

(56) References Cited

U.S. PATENT DOCUMENTS

| | | | | |
|---|---|---|---|---|
| 6,161,807 | A * | 12/2000 | Steiner | F16M 11/046 182/181.1 |
| 6,755,282 | B1 * | 6/2004 | Herold | B25H 1/06 182/181.1 |
| 6,772,564 | B2 | 8/2004 | Leon | |
| 6,796,049 | B1 | 9/2004 | Claxton | |
| 7,607,264 | B2 * | 10/2009 | Weber | E02D 27/01 248/351 |
| 7,946,093 | B1 | 5/2011 | Sturino | |
| 9,322,186 | B1 | 4/2016 | Chang | |
| 2001/0050456 | A1 * | 12/2001 | Wallis | B25B 5/145 269/43 |
| 2002/0079277 | A1 * | 6/2002 | Huang | A47F 5/137 211/206 |
| 2003/0159886 | A1 * | 8/2003 | McGillis | B27B 21/00 182/186.3 |
| 2005/0023083 | A1 * | 2/2005 | Reimer | E01F 13/02 182/186.3 |
| 2005/0252167 | A1 * | 11/2005 | Van Horne | E04F 21/22 52/749.1 |
| 2005/0284040 | A1 * | 12/2005 | Hashimoto | E04F 15/02458 52/126.1 |
| 2009/0183948 | A1 * | 7/2009 | Sciorrotta, Jr. | B25H 1/06 182/153 |
| 2015/0184355 | A1 | 7/2015 | Wang | |
| 2015/0267420 | A1 | 9/2015 | Fontana | |

* cited by examiner

FLOOR-TRANSITION SETTING SYSTEMS

BACKGROUND OF THE INVENTION

The following includes information that may be useful in understanding the present disclosure. It is not an admission that any of the information provided herein is prior art, or material, to the presently described or claimed inventions, or that any publication or document that is specifically or implicitly referenced is prior art.

1. Field of the Invention

The present invention relates generally to the field of flooring installation and more specifically relates to flooring setting systems.

2. Description of Related Art

Flooring is a general term for a semi-permanent covering of an unfinished surface of the ground, such as concrete or unfinished wood. Flooring generally includes tile, wood, laminate, and/or synthetic materials. Each type of flooring often requires a different method of installation. Some types of flooring require being affixed to the unfinished surface or sub-floor by adhesives (e.g., glue, epoxy, etc.).

Wood flooring and related trim pieces are often installed by the "glue-down" method which is often used when wood is placed upon a concrete or other solid surface. Also, wooden stairs and trim is often affixed by adhesive. In many instances, the unfinished surface/sub-floor may not be completely flat and/or level. Additionally, many natural wood products are sometimes not fully uniform and may have a bow or be prone to warping when adhesive is applied. Environmental factors such as heat or humidity may affect the gluing of the flooring materials to the sub-floor. Further, gluing or affixing wooden materials by adhesive often requires adequate and/or continuous pressure to ensure proper setting while the adhesive is curing and/or drying. Therefore a suitable solution is desired.

Several attempts have been made to solve the above-mentioned problems such as those found in US and Foreign Patent and Publication Numbers: U.S. Pat. No. 6,796,049 to Claxton; U.S. Pat. No. 6,047,520 to Caraballo; U.S. Pat. No. 5,867,965 to Pitz et al.; U.S. Pat. No. 6,772,564 to Leon; U.S. Pat. No. 3,643,992 to Jaccobucci; U.S. Pat. No. 4,091,945 to Patterson; U.S. Pat. No. 5,862,633 to Jones; U.S. Pat. No. 7,946,093 to Sturino; U.S. Pat. No. 9,322,186 to Chang et al.; US 2015/0267420 to Fontana; US 20150184355 to Wang; and CA 2,790,556 to Bordin. This art is representative of flooring installation. However, none of the above references, taken either singly or in combination, is seen to describe the invention as claimed.

BRIEF SUMMARY OF THE INVENTION

In view of the foregoing disadvantages inherent in the known flooring installation art, the present disclosure provides a novel floor-transition-setting system. The general purpose of the present disclosure, which will be described subsequently in greater detail is to provide adequate pressure during setup and curing of adhesive used during construction while being configurable to a wide range of applications.

A system for setting flooring or floor-transition-setting system is disclosed herein, in a preferred embodiment, including a connector-body, a plurality of extension-bodies, a plurality of leg-members, and a plurality of pressure-feet. The connector-tubular-body being in functional and adjustable combination with each of a plurality of female-push-button-couplers. The connector-body, the plurality of extension-bodies, the plurality of leg-members, and the plurality of pressure-feet are each in functional and structural combination with each other.

Each of the plurality of extension-bodies have a male-push-button-adjuster-coupler and an extension-tubular-body, with the extension-tubular-body being in functional combination with the male-push-button-adjuster-coupler. Similarly, each of the plurality of the leg-members have a connector-ring and a leg-tubular-body with the connector-ring being in functional combination with the leg-tubular-body each. The plurality of pressure-feet are configured such that each of the plurality of pressure-feet are located adjacent to, and contacting a construction-material during use.

Relationally speaking, each of the female-push-button-couplers of the connector-body is removably and slidably coupleable to each of the male-push-button-adjuster-coupler of the extension-bodies, so as to provide an adjustable length of the floor-transition-setting system. Each of the plurality of pressure-feet is preferably removably and adjustably coupleable to an individual leg-tubular-body of the plurality of leg-members, respectively. Additionally, at least one of each of the connector-rings are structured and arranged to encompass each of the extension-tubular-bodies of the plurality of extension-bodies, to provide a rotatable affixation.

The floor-transition-setting system, in the preferred embodiment, is structured and arranged to allow a user to provide adjustable pressure to construction-materials, such that the user can provide increased pressure to the construction-material during assembly. Each of the plurality of pressure-feet may include a threaded-connection configured such that the user can adjust a distance between each of the pressure-feet and the construction-material via rotation, and provide the desired-pressure during use. Preferably, each of the pressure-feet include a locking-pin-pivot configured to allow the user to variably affix the floor-transition-setting system at a variety of angles to accommodate a wide variety of uses, and each of the pressure-feet preferably include a suction-cup configured to provide the user with additional friction between the floor-transition-setting system and the construction-material during use.

In the preferred embodiment, the floor-transition-setting system is constructed from a ferrous-metallic material, configured for durability during use, and each of the plurality of pressure-feet may also include a rubberized material for traction and durability during use.

According to another embodiment, a method for using floor-transition-setting system is also disclosed herein. The method for using floor-transition-setting system includes the steps of: providing a floor-transition-setting system, installing construction-materials, placing the floor-transition-setting system adjacent to and contacting the construction-materials, adjusting the floor-transition-setting system to provide a desired-pressure to the construction-materials, allowing the construction-materials to cure and/or set for a predetermined time-interval, removing the floor-transition-setting system from the construction-materials after the expiration of the predetermined time-interval, and disassembling the floor-transition-setting system For purposes of summarizing the disclosure, certain aspects, advantages, and novel features of the disclosure have been described herein. It is to be understood that not necessarily all such advantages may be achieved in accordance with any one particular embodiment of the disclosure. Thus, the disclosure may be embodied or carried out in a manner that achieves or optimizes one advantage or group of advantages as taught herein without necessarily achieving other advantages as may be taught or suggested herein.

The features of the disclosure which are believed to be novel are particularly pointed out and distinctly claimed in the concluding portion of the specification. These and other features, aspects, and advantages of the present disclosure will become better understood with reference to the following drawings and detailed description.

BRIEF DESCRIPTION OF THE DRAWINGS

The figures which accompany the written portion of this specification illustrate embodiments and methods of use for the present disclosure for a floor-transition-setting system, which may be constructed and operative according to the teachings of the present disclosure.

The various embodiments of the present disclosure will hereinafter be described in conjunction with the appended drawings, wherein like designations denote like elements.

DETAILED DESCRIPTION

Figure 1A:
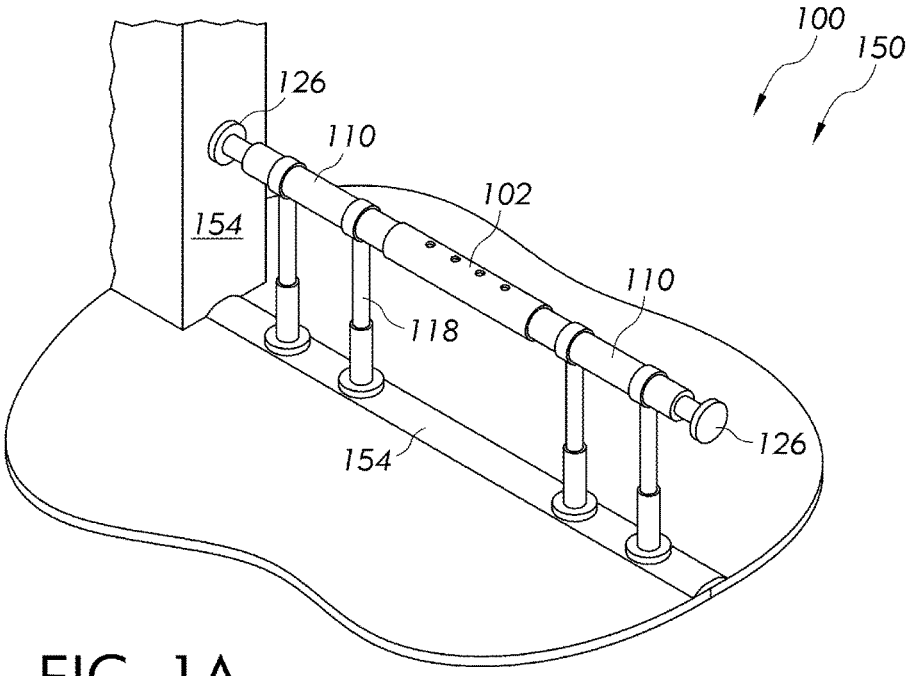
FIG. 1A shows a perspective view illustrating a floor-transition-setting system during an 'in-use' condition, according to an embodiment of the disclosure.
Figure 1B:
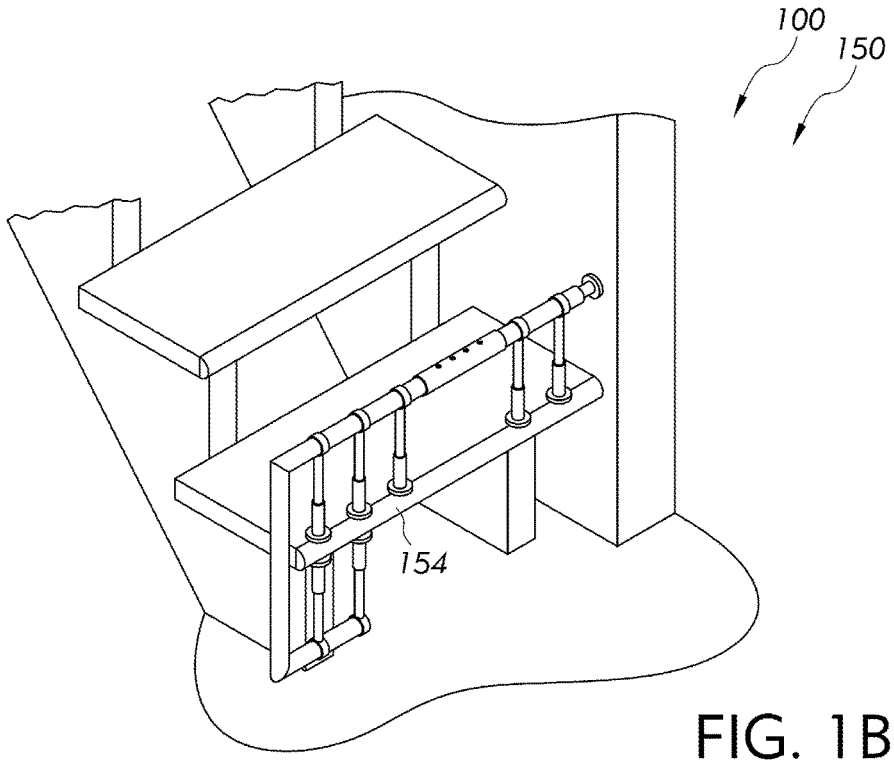
FIG. 1B shows a perspective view illustrating a floor-transition-setting system during an 'in-use' condition, according to another embodiment of the disclosure.
Figure 1C:
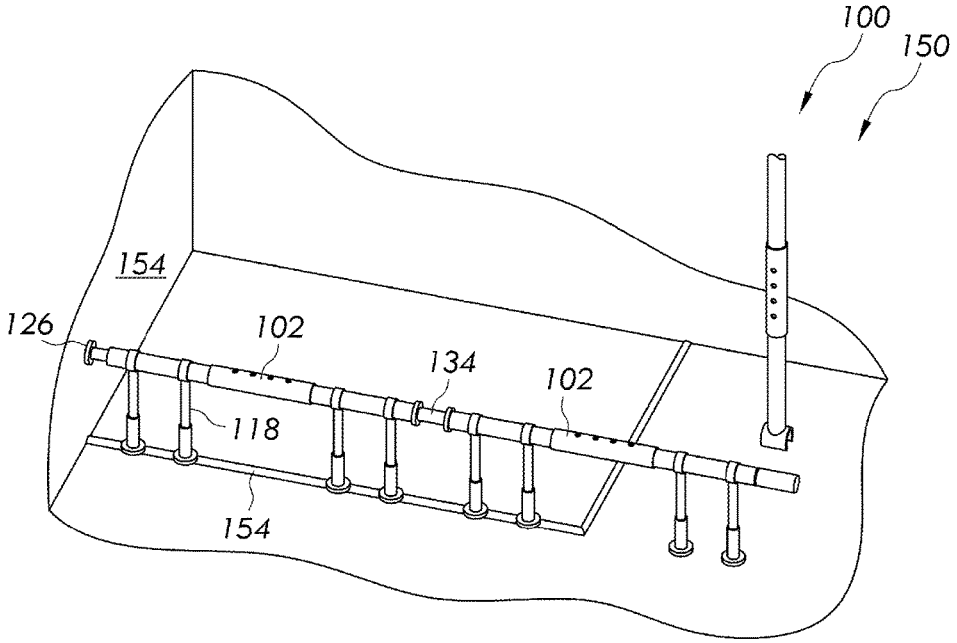
FIG. 1C shows a perspective view illustrating a floor-transition-setting system during an 'in-use' condition, according to yet another embodiment of the present disclosure.
Figure 1D:
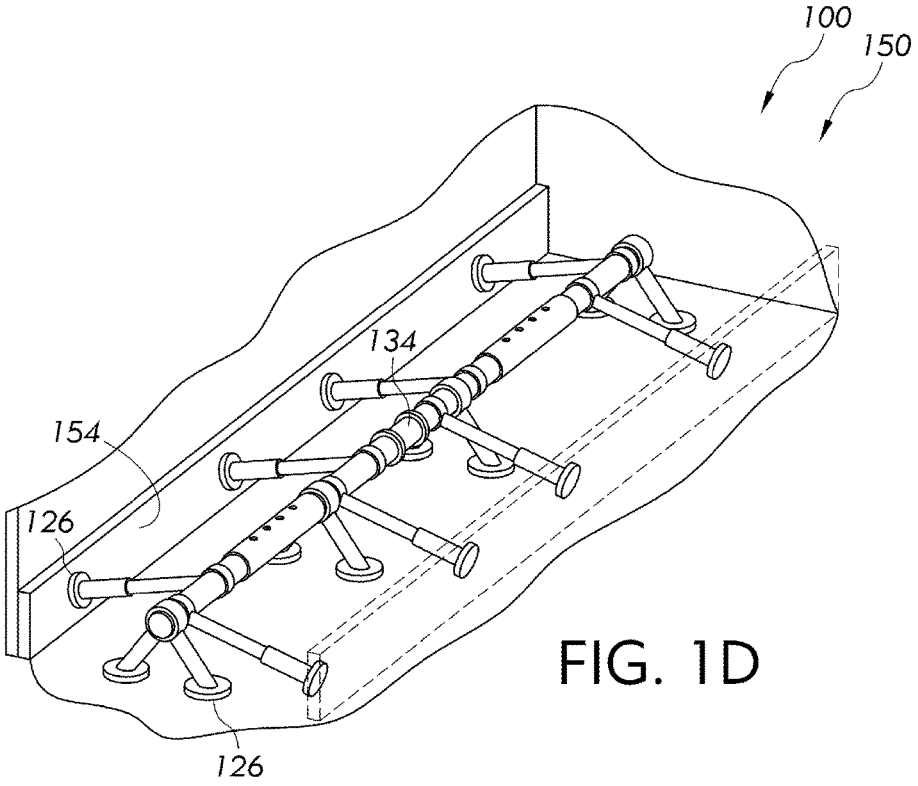
FIG. 1D shows a perspective view illustrating a floor-transition-setting system during an 'in-use' condition, according to an alternate embodiment of the present disclosure.
Figure 1E:
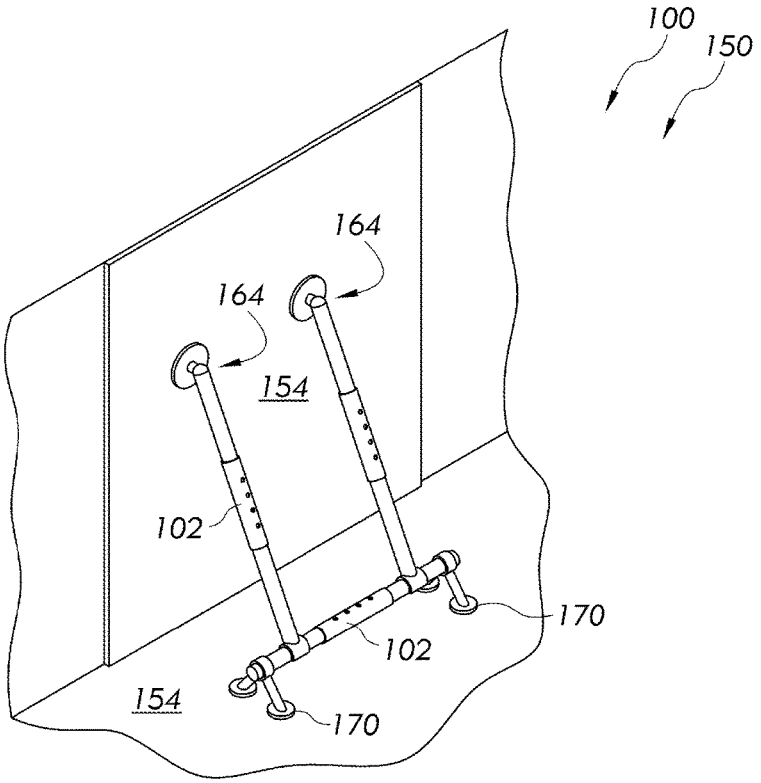
FIG. 1E shows a perspective view illustrating a floor-transition-setting system during an 'in-use' condition, according to a further embodiment of the present disclosure.

As discussed above, embodiments of the present disclosure relate to a flooring installation system and more particularly to a system for setting flooring transitions or floor-transition-setting system as used to improve the installation of construction material that may require the use of constant pressure for set-up and/or curing.

The present disclosure may offer significant improvements and serve as a floor-transition-setting system. Preferably, a flooring installation should provide a modular system with adequate pressure during setup and curing of adhesive, or other installation methods requiring constant and continued pressure during installation, while being configurable to a wide range of applications, and yet, would operate reliably and be manufactured at a modest expense. Thus, a need exists for a reliable floor-transition-setting system to avoid the above-mentioned problems.

Generally speaking, a floor-transition-setting system includes at least one assembly, having an adjustable width and height, that is configured to press and hold down flooring items such as floor transitions, trims, strips, end caps and other constructed sections in place while being set. The floor-transition-setting system or assembly may be constructed with an adjustable width and height, adjustable tension, and various sizes and/or lengths. The floor-transition-setting system may further include padding to prevent damage pressure points, and is preferably easily adjustable to fit the needs of a user. Once adjusted, the floor-transition-setting system may apply setting pressure to a plurality of spaced or distributed points to hold the flooring materials in place while being set, and prevent movement or other disturbance during setting. Beneficially, such an arrangement may solve the problem of setting flooring items rising out of position or being disturbed while its adhesive is curing.

Referring now more specifically to the drawings by numerals of reference, there is shown in FIGS. 1-4 various views of a system for setting flooring transitions and flooring (floor-transition-setting system 100) in an "in use" condition 150. As illustrated, the floor-transition-setting system 100 may include a connector-body 102, a plurality of extension-bodies 110, a plurality of leg-members 118, and a plurality of pressure-feet 126.

By way of example, and with reference to FIG. 1A, here a simplified floor-transition-setting system 100 includes a first 90 degree assembly, having at least one vertical leg member 118 that is each adjustably coupled to a downward pressing pressure-foot 126 at a bottom end, and rotatably coupled to an extension-body 110 at a top end. The extension-body 110 is then adjustably coupled to a sideways pressing pressure-foot 126 at an outward side (90 degrees from the vertical leg member 118) of the extension-body 110. The simplified floor-transition-setting system 100 further includes a second 90 degree assembly that is substantially the same as the first assembly. The first and second assemblies are then toollessly coupled to each other's inner side, opposite their outer side, respectively, via a connector-body 102. Functionally, in this particular configuration, floor-transition-setting system 100 is arranged to be inserted in a door jamb and apply pressure to a door threshold (saddle). In particular, while the two sideways pressing pressure-feet 126 apply pressure to the door jamb, they acquire sufficient opposing normal force to create sheer friction fit with the door jamb, locking the entire floor-transition-setting system 100 in place vertically. Against this friction force, the downward pressing pressure-foot 126 have a reaction force sufficient to apply the required curing pressure to the saddle. Removal would require adjusting each foot pressure-foot 126 away from their applied pressure direction. Accordingly, connector-body 102, plurality of extension-bodies 110, plurality of leg-members 118, and plurality of pressure-feet 126 may be in functional and structural combination with each other. Floor-transition-setting system 100 may be structured and arranged to allow a user to provide adjustable pressure to construction-materials 154, such that the user may provide increased pressure to construction-material 154 during assembly.

Figure 2:
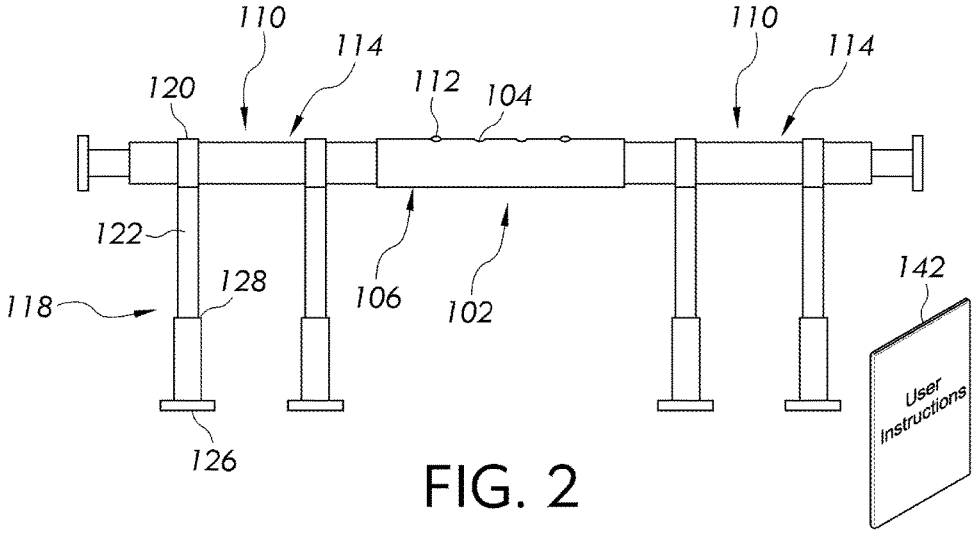
FIG. 2 is a front view illustrating an exemplary floor-transition-setting system kit, according to the embodiments of the disclosure.
Figure 3:
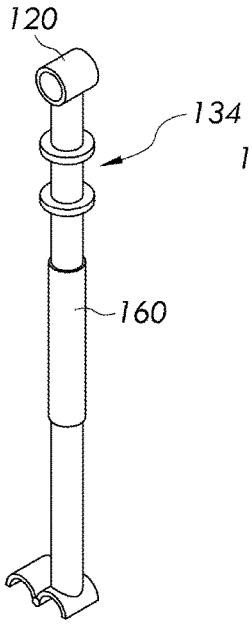
FIG. 3 is a perspective view illustrating a tensioner-body, a connector-ring, and a multi-connector of the floor-transition-setting system, according to embodiments of the present disclosure.

According to one embodiment, and with reference to FIG. 2, floor-transition-setting system 100 may be configured for toolless coupling. In particular, each connector-body 102 may include a plurality of female-push-button-couplers 104 and aconnector-tubular-body 106, with each connector-tubular-body 106 being in functional and adjustable combination with each female-push-button-coupler 104. Each extension-body 110 may include male-push-button-adjuster-coupler 112 and extension-tubular-body 114, with each extension-tubular-body 114 being in functional combination with each male-push-button-adjuster-couplers 112. Together, the female-push-button-couplers 104 of connector-body(s) 102 may be removably and slidably coupleable to each male-push-button-adjuster-coupler 112 of extension-bodies 110 in a telescopic fashion, so as to toollessly provide an adjustable (here, horizontal) length to floor-transition-setting system 100. It is understood, that other orientations (e.g., vertical, angled, etc.) are contemplated.

Each leg-member 118 may include connector-ring 120 and leg-tubular-body 122, with connector-ring 120 being in functional combination with each leg-tubular-body 122. Each pressure-foot 126 may be configured such that each pressure-foot 126 may be located adjacent to and contacting construction-material 154 (FIG. 1) during use.

Pressure-feet 126 may be removably and adjustably coupleable to an individual leg-tubular-body 122 of plurality of leg-members 118, respectively. Connector-rings 120 may be structured and arranged to encompass each extension-tubular-body 114 of each extension-body 110, to provide a rotatable affixation. Pressure-feet 126 may further include a threaded-connection configured such that the user may adjust a distance between each pressure-foot 126 and construction-material 154 via rotation, and provide the desired-pressure during use.

Figure 4A:
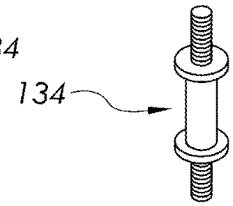
FIG. 4A is a perspective view illustrating the tensioner-body of the floor-transition-setting system, according to embodiments of the present disclosure.
Figure 4B:
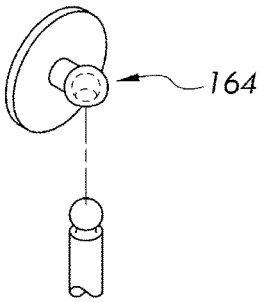
FIG. 4B is a perspective view illustrating a ball-point-pivot of the floor-transition-setting system, according to the embodiments of the present disclosure.
Figure 4C:
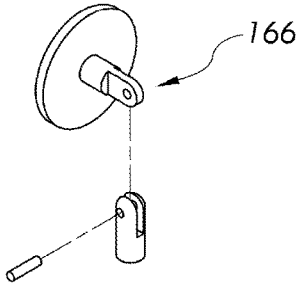
FIG. 4C is a perspective view illustrating a locking-pin-pivot of the floor-transition-setting system, according to embodiments of the present disclosure.

Referring to FIG. 4B, the pressure-feet 126 may further include a ball-point-pivot 164 configured to allow the user to variably affix floor-transition-setting system 100 at a variety of angles. Also, with reference to FIG. 4C, the pressure-feet 126 may further include a locking-pin-pivot 166 configured to allow the user to variably affix floor-transition-setting system 100 at a variety of angles.

Figure 4D:
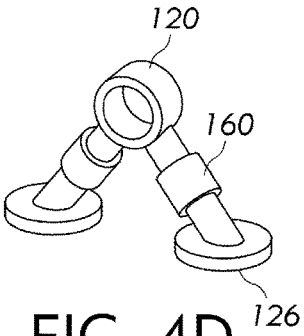
FIG. 4D is a perspective view illustrating a connector-ring, pressure-feet, and the tensioner-body of the floor-transition-setting system, according to embodiments of the present disclosure.
Figure 4E:
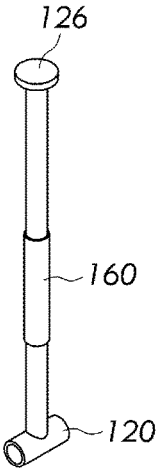
FIG. 4E is a perspective view illustrating another embodiment of the connector-ring, the pressure-feet, and the tensioner-body of the floor-transition-setting system, according to the present disclosure.
Figure 4F:
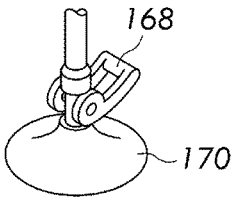
FIG. 4F is a perspective view illustrating a toggle-switch and a suction-cup of the floor-transition-setting system, according to embodiments of the present disclosure.

Referring to FIG. 4F, the pressure-feet 126 may further include a quick-release or toggle-switch 168 configured to provide the user with a quick means for adjusting the desired-pressure during use. Additionally, and as shown, the pressure-feet 126 may also include a suction device such as suction-cup 170, which is configured to provide the user with additional resistance, grip, or friction against lateral movement between floor-transition-setting system 100 and construction-material 154 during use. The suction-cup 170 may advantageously replace a pressure-foot 126 on a smooth surface such as ceramic, for example. Similarly, the plurality of pressure-feet 126 may also include a construction based on a rubberized or other non-slip material configured for traction and durability during use.

Referring to FIGS. 4D and 4E, the floor-transition-setting system 100 may also include a tensioner-body 160 structured and arranged between one or more extension-bodie(s) 110 (FIG. 1) and/or at least one pressure-foot 126, tensioner-body 160 configured to provide the user with a wider operational use such that floor-transition-setting system 100 may accommodate wider and/or narrower uses.

Referring to FIG. 4A, the floor-transition-setting system 100 may include a multi-connector 134 that is structured and arranged to provide the user with a variable-length device. The multi-connector 134 may be configured to connect at least one of one or more extension-bodies 110 (FIG. 1), one or more tensioner-bodies 160 (FIG. 4D), and/or one or more extension-bodies 110. For example, the multi-connector 134 may include opposing threaded stud, separated by any convenient distance via structural member, where each stud is configured to engage via the same mechanism as a pressure-foot 126 (FIG. 1), for example. According to one embodiment, the floor-transition-setting system 100 may include multi-connector 134 configured to removably couple two or more systems during use to provide a modular and variable system, similar to the simplified system described above.

Figure 4G:
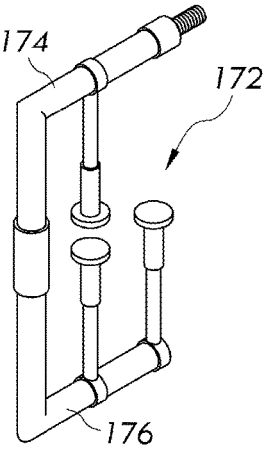
FIG. 4G is a perspective view illustrating a toggle-switch and a suction-cup of the floor-transition-setting system, according to embodiments of the present disclosure.

Referring to FIG. 4G, the floor-transition-setting system 100 may also be arranged as a c-press-adapter 172. The c-press-adapter may include a first-right-angle-member and a second-right-angle-member. The c-press-adapter 172 may additionally include one or more pressure-feet 126. C-press-adapter 172 may additionally include one or more leg-members. As illustrated, in addition to being modular and adjustable, the c-press-adapter 172 may beneficially be configured asymmetrically.

Floor-transition-setting system 100 may also be adaptable to accommodate the construction and installation of stair treads, by utilizing the riser of the stair, and/or the lower and/or upper stair tread (and/or riser), as well as the stair stringer. Also, floor-transition-setting system 100 may also be useful for the installation and/or repair of cabinetry (including but not limited to installations and/or repairs in bathrooms, kitchens, etc.), as well as providing a functional use for the construction and/or repair of furniture and finishing items.

Floor-transition-setting system 100 may be constructed from a ferrous-metallic material configured for durability during use, may be constructed from a non-ferrous-metallic material configured to be lightweight and provide durability during use, or may beconstructed from a plastic material configured for non-reactive properties during use, according to user requirements and preferences.

Referring to FIG. 2, it should be noted that floor-transition-setting system 100 may be arranged as a kit, for example, with the following parts: at least one connector-body 102, at least one extension-body 110, at least one leg-member 118, a plurality of pressure-feet 126, and at least one set of user instructions 142. The kit has instructions 142 such that functional relationships are detailed in relation to the structure of the disclosure (such that the disclosure can be used, maintained, or the like in a preferred manner).

Floor-transition-setting system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
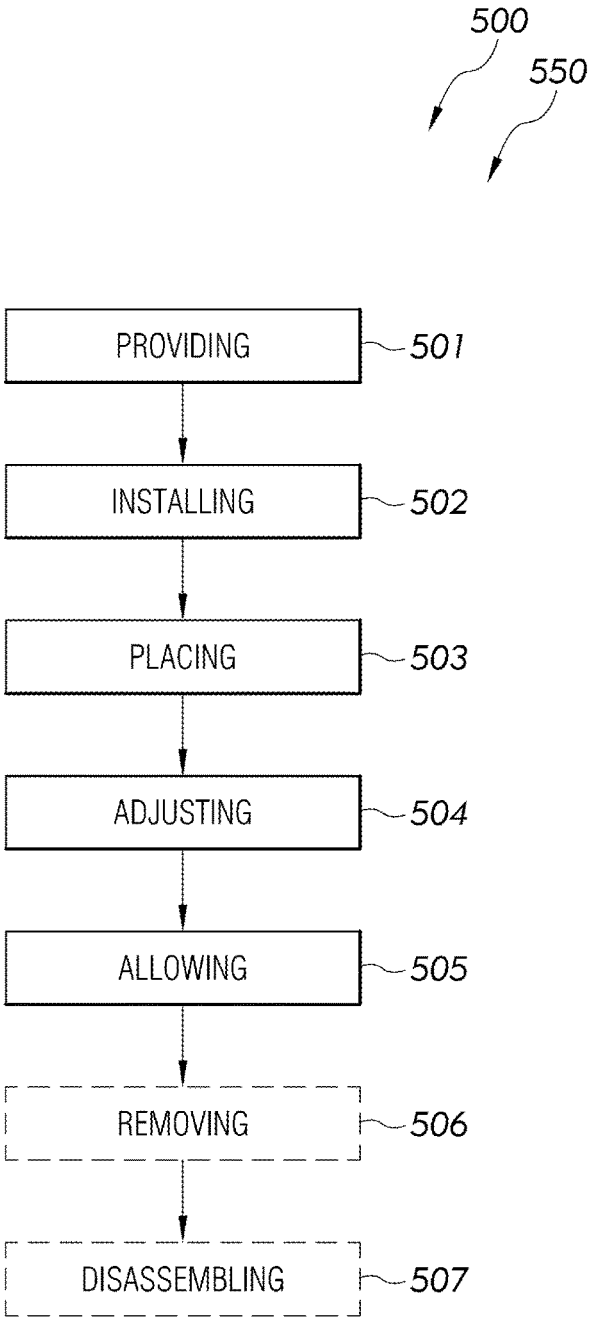
FIG. 5 is a flow diagram illustrating a method of use for the floor-transition-setting system, according to an embodiment of the present disclosure.

Referring now to FIG. 5 showing a flow diagram 550 illustrating method of use 500 for floor-transition-setting system 100 of FIGS. 1-4, according to an embodiment of the present disclosure. As shown, method of use 500 may include the steps of: step one 501, providing a floor-transition-setting assembly, step two 502, installing construction-materials 154, step three 503, placing the floor-transition-setting system 100 adjacent to and contacting construction-materials 154, step four 504, adjusting the floor-transition-setting system 100 to provide a desired-pressure to construction-materials 154, step five 505, allowing construction-materials 154 to cure and/or set for a predetermined time-interval, step six 506, removing the floor-transition-setting system 100 from construction-materials 154 after the expiration of the predetermined time-interval, and step seven 507, disassembling floor-transition-setting system 100.

It should be noted that step six 506 and step seven 507 are optional steps, and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. §112(f). Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the disclosure described herein are exemplary and numerous modifications, variations and rearrangements can be readily envisioned to achieve substantially equivalent results, all of which are intended to be embraced within the spirit and scope of the disclosure. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A system for setting flooring transitions, the system comprising:

a connector-body including:

a plurality of female-push-button-couplers and a connector-tubular-body, said connector-tubular-body being in functional and adjustable combination with each of said plurality of female-push-button-couplers;

a plurality of extension-bodies, each extension-body having a male-push-button-adjuster-coupler and an extension-tubular-body, said extension-tubular-body being in functional combination with said male-push-button-adjuster-coupler;

a plurality of leg-members, each leg-member having a connector-ring and a leg-tubular-body, said connector-ring being in functional combination with said leg-tubular-body; and a plurality of pressure-feet configured such that each of said plurality of pressure-feet are located adjacent to and contacting a construction-material during use;

wherein each of said female-push-button-couplers of said connector-body is removably and slidably coupleable to each of said male-push-button-adjuster-coupler of said extension-bodies so as to provide an adjustable length of said system;

wherein each of said plurality of pressure-feet are removably and adjustably coupleable to an individual leg-tubular-body of said plurality of leg-members, respectively;

wherein at least one of each of said connector-rings are structured and arranged to encompass each of said extension-tubular-bodies of said plurality of extension-bodies, to provide a rotatable affixation;

wherein said system is structured and arranged to allow a user to provide adjustable pressure to construction-materials such that said user can provide pressure to said construction-material during assembly.

2. The system of claim 1, wherein each of said plurality of pressure-feet further include a threaded-connection configured such that said user can adjust a distance between each of said pressure-feet and said construction-material via rotation and provide said pressure during use.

3. The system of claim 1, further comprising a tensioner-body structured and arranged between at least one of said plurality of extension-bodies and at least one of said pressure feet.

4. The system of claim 1, further comprising a multi-connector structured and arranged to provide said user with a variable-length device configured to connect at least one of one or more extension-bodies or one or more tensioner-bodies.

5. The system of claim 1, wherein each of said pressure-feet further includes a ball-point-pivot configured to allow said user to variably affix said system at a variety of angles.

6. The system of claim 1, wherein each of said pressure-feet further includes a locking-pin-pivot configured to allow said user to variably affix said system at a variety of angles.

7. The system of claim 1, wherein each of said pressure-feet further includes a toggle-switch configured to allow said user to adjust said pressure during use.

8. The system of claim 1, wherein said each of said pressure-feet further includes a suction-cup configured to provide said user with friction between said system and said construction-material during use.

9. The system of claim 1, further comprising a c-press-adapter, said c-press-adapter including a first-right-angle-member and a second-right-angle-member.

10. The system of claim 9, wherein said c-press-adapter additionally includes said one or more pressure-feet.

11. The system of claim 9, wherein said c-press-adapter additionally includes said one or more leg-members.

12. The system of claim 1, wherein said system is constructed from a ferrous metallic material.

13. The system of claim 1, wherein said connector-tubular-body is constructed from a non-ferrous-metallic material configured to be lightweight to provide durability during use.

14. The system of claim 1, wherein said connector body is constructed from a plastic material configured for non-reactive properties during use.

15. The system of claim 1, wherein each of said plurality of pressure-feet include a rubberized material for traction and durability during use.

16. The system of claim 1, further comprising a multi-connector configured to removably couple two or more floor-transition setting assemblies during use.

17. A floor-transition-setting system comprising:

a connector-body including a plurality of female-push-button-couplers and a connector-tubular-body, said connector-tubular-body being in functional and adjustable combination with each of said plurality of female-push-button-couplers;

a plurality of extension-bodies, each extension-body having a male-push-button-adjuster-coupler and an extension-tubular-body, said extension-tubular-body being in functional combination with said male-push-button-adjuster-coupler;

a plurality of leg-members, each leg-member having a connector-ring and a leg-tubular-body, said connector-ring being in functional combination with said leg-tubular-body; and a plurality of pressure-feet configured such that each of said plurality of pressure-feet are located adjacent to and contacting a construction-material during use;

wherein each of said female-push-button-couplers of said connector-body is removably and slidably coupleable to each of said male-push-button-adjuster-coupler of said extension-bodies so as to provide an adjustable length of said floor-transition-setting system;

wherein each of said plurality of pressure-feet are removably and adjustably coupleable to an individual leg-tubular-body of said plurality of leg-members, respectively;

wherein at least one of each of said connector-rings are structured and arranged to encompass each of said extension-tubular-bodies of said plurality of extension-bodies, to provide a rotatable affixation;

wherein said floor-transition-setting system is structured and arranged to allow a user to provide adjustable pressure to construction-materials such that said user can provide pressure to said construction-material;

wherein each of said plurality of pressure-feet include a threaded-connection configured such that said user can adjust a distance between each of said pressure-feet and said construction-material via rotation and provide said pressure during use;

wherein each of said pressure-feet each include a suction-cup configured to provide said user with friction between said floor-transition-setting system and said construction-material during use;

wherein said floor-transition-setting system is constructed from a ferrous-metallic material; and wherein each of said plurality of pressure-feet include a rubberized material for traction and durability during use.

18. The floor-transition-setting system of claim 17, further comprising: a set of user instructions; and wherein the floor-transition-setting system is arranged as a kit.

19. A method of using a floor-transition-setting system comprising the steps of:

providing the system of claim 1;

installing construction-materials;

placing said system adjacent to and contacting said construction-materials;

adjusting said system to provide pressure to said construction-materials; and allowing said construction-materials to cure and/or set for a predetermined time-interval.

20. The method of claim 19, further comprising the steps of:

removing said system from said construction-materials after the expiration of said predetermined time-interval; and disassembling said system.

* * * * *